US005091118A

United States Patent [19]

Burgher

[11] Patent Number: 5,091,118

[45] Date of Patent: Feb. 25, 1992

[54] DEVICE FOR DISSOLVING GASSES INTO LIQUIDS

[76] Inventor: Peter H. Burgher, 15158 Wiles Dr., Captiva, Fla. 33924

[21] Appl. No.: 594,651

[22] Filed: Oct. 9, 1990

[51] Int. Cl.[5] ..... B01F 3/04

[52] U.S. Cl. ..... 261/76; 261/123; 261/DIG. 75; 261/64.4

[58] Field of Search ..... 261/DIG. 75, 123, 76, 261/64.4

[56] References Cited

U.S. PATENT DOCUMENTS

| | | | |
|---|---|---|---|
| Re. 21,416 | 4/1940 | Sargent | 261/DIG. 75 |
| 175,827 | 4/1876 | Deeds | 261/123 |
| 1,973,784 | 9/1934 | Voigt | 261/123 |
| 3,282,227 | 11/1966 | Nielsen | 261/DIG. 75 |
| 3,780,198 | 12/1973 | Pahl et al. | 261/DIG. 75 |
| 4,042,510 | 8/1977 | Sullins | 261/DIG. 75 |
| 4,100,071 | 7/1978 | Beurer | 261/123 |
| 4,168,705 | 9/1979 | Raab | 261/DIG. 75 |
| 4,370,304 | 1/1983 | Hendriks et al. | 261/76 |

FOREIGN PATENT DOCUMENTS

| | | | |
|---|---|---|---|
| 958322 | 11/1974 | Canada | 261/DIG. 75 |

*Primary Examiner*—Tim Miles
*Attorney, Agent, or Firm*—Brooks & Kushman

[57] ABSTRACT

An apparatus for dissolving a gas, such as oxygen, into a liquid, such as water, having a low concentration of that gas. The apparatus has an inlet, an outlet and a central region therebetween and has walls defining an interior adapted for dissolving the gas in the liquid. The apparatus also has a gas injecting means adapted for maximizing a gas-liquid interface and promoting contact between the gas and the liquid, thereby maximizing the concentration of the gas in the liquid. The apparatus is useful for modifying the liquid for a specific purpose, such as for developing a culture medium. The apparatus can have different internal configurations, depending on the degree of gas linkage and retention required.

12 Claims, 2 Drawing Sheets

DEVICE FOR DISSOLVING GASSES INTO LIQUIDS

TECHNICAL FIELD

The present invention relates to an apparatus for dissolving a gas into a liquid having the characteristic of being low in concentration of the gas upon entry into the apparatus.

BACKGROUND ART

Over the years, practitioners experienced in the use of culture media have learned that growth rates can be enhanced and the chance of disease can be reduced by modifying the culture medium. This modification can be achieved through the addition of a gas or gasses to the medium. For example, fish yield and disease reduction in a fish hatchery or farm can be significantly enhanced by adding a gas, such as oxygen, to the culture medium, such as water.

In the past, a water culture medium has been modified through aeration, which is accomplished by spraying the medium into the air or by agitating it by means of paddles or the like. This method, however, results in the addition of nitrogen to the medium as the air is dissolved into the medium, a problem of significance to the fish culture industry. As fish consume the oxygen admitted by aeration, the nitrogen proportion in the water increases and can reach levels that are detrimental to life.

The prior art also teaches the introduction of pure oxygen into the culture medium by means such as bubbling, water towers and the like. These methods, however, have serious cost and effectiveness limitations. Concentrated oxygen is expensive, and the equipment required to dispense the oxygen often represents a substantial investment. Additionally, one of the most limiting aspects of gas addition to fluids is the inherent tendency of any such added gas to disassociate itself from the fluid carrier over time during agitation, pumping, or movement. Prior to the present invention, there have been essentially no practical, low-cost devices specifically designed for the efficient addition of gasses (including oxygen) to a fluid culture medium such as water.

DISCLOSURE OF THE INVENTION

A system is provided for dissolving a gas delivered from a gas supply in a liquid which moves through the system, the liquid having the characteristic of being low in concentration of the gas upon entry into the system. The system includes a substantially closed chamber having an inlet through which the liquid flows, an outlet from which the liquid leaves the system, and a central region which defines an interior adapted for dissolving the gas in the liquid. The chamber also has an orifice for introducing the gas into the chamber.

The system includes one or more venturis arranged in series in the chamber so that the liquid may flow around, by, or through the one or more venturis. The one or more venturis are adapted to maximize a gas-liquid interface and promote contact between the gas and the liquid, thereby dissolving the gas in the liquid and maximizing concentration of the gas in the liquid.

The present invention overcomes the problems and cost limitations of the prior art by being compatible with existing plumbing and recirculation system components and is intended to be installed in line with existing plumbing systems. The invention is also compact in size. All of these features result in a low cost device for dissolving gasses into liquids.

The various embodiments of the invention utilize similar exterior components. In one embodiment, these components include various sizes of piping, such as rigid PVC pipe, arranged to form a chamber of varying diameter and length for housing the gas injecting means. By utilizing commercially available PVC piping, the device can be assembled by conventional sawing, threading and gluing fabrication techniques.

Accordingly, it is a general object of this invention to provide a low-cost, effective apparatus for modifying a liquid culture medium by dissolving a gas in the culture medium.

It is also an object of the present invention to provide an apparatus for dissolving a gas into a liquid, the apparatus having a chamber and a gas injecting means, wherein the gas injecting means utilizes one or more venturis to maximize the quantity of gas dissolved in the liquid.

The above objects and other objects and features of the invention will be readily known to one of ordinary skill in the art from the following detailed description of the best modes for carrying out the invention when taken in connection with the following drawings.

BEST MODES FOR CARRYING OUT THE INVENTION

Figure 1:
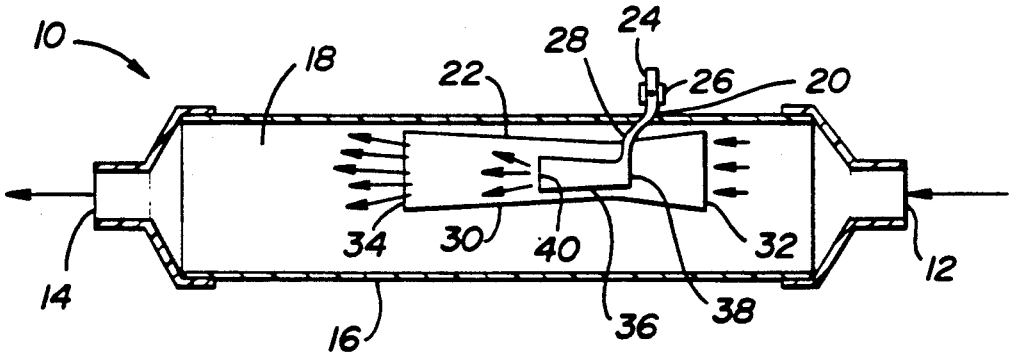
FIG. 1 is a longitudinal cross-sectional view of a first embodiment of the present invention.

Referring now to FIG. 1, a first embodiment of the gas dissolution system is shown generally by reference numeral 10. The gas dissolution system 10 comprises a substantially closed chamber 16 having an inlet 12 through which the liquid enters the system and an outlet 14 from which the liquid leaves the system. The substantially closed chamber 16 has walls defining an interior 18 for disposing of gas injecting means 22.

Gas injecting means 22 is comprised of straight pipe 24 having a check valve 26, and venturi 30. Straight pipe 24 is connected to a gas supply means (not specifically illustrated) and extends to orifice 20 of substantially closed chamber 16 and is fixedly attached thereto. Check valve 26 permits the flow of gas into gas injection means 22 and prohibits inadvertent flow of liquid into the straight pipe 24. Straight pipe 24 is made of a commercially available and known material, such as PVC.

Venturi 30 has a pipe 28, an inlet 32 through which the liquid flows, an outlet 34 from which the liquid leaves venturi 30, and a horn 36. Pipe 28 is attached to substantially closed chamber 16 at orifice 20 and extends through venturi 30 to horn 36, thereby establishing fluid communication between the gas supply means and horn 36. Pipe 28 is made of a commercially available and known material, such as copper or stainless steel.

Horn 36 is disposed within venturi 30 and has an inlet 38 and an outlet 40. Horn 36 has a first diameter at inlet 38 and thereafter widens to a final diameter at outlet 40. The horn 36 is positioned within venturi 30 such that the horn inlet 38 is aligned with the smallest diameter of venturi 30.

The liquid enters substantially closed chamber 16 through inlet 12, as indicated by the arrow. Upon entering substantially closed chamber 16, the liquid then enters venturi 30 through venturi inlet 32 and horn 36 through horn inlet 38.

The shape of the venturi results in an acceleration of the liquid as it passes therethrough. As the accelerated liquid passes through venturi 30 and horn 36, a vacuum is created in the horn 36 from the horn inlet 38 to the horn outlet 40, thereby introducing the gas into the flowing, liquid from the gas supply means through pipe 28. As the liquid and gas mixture travel through the horn 36, the liquid and gas mixture expands, and the gas is dissolved into the liquid. The liquid and any undissolved gas exits horn 36 through horn outlet 40 and venturi 30 through venturi outlet 34, and interacts with the liquid that did not pass through venturi 30. This interaction leads to further gas dissolution as the liquid travels through the remainder of chamber 16 prior to exiting system 10 at outlet 14.

As indicated, system 10 utilizes a single venturi for dissolving the gas into the liquid. Good results are obtained when the area of venturi inlet 32 equals the annular area between the venturi inlet 32 and the chamber 16. By using a venturi with an inlet thus sized, the effective area of the gas-liquid interface is enlarged. Therefore, the quantity of gas dissolved in the liquid by the venturi is maximized.

Figure 2:
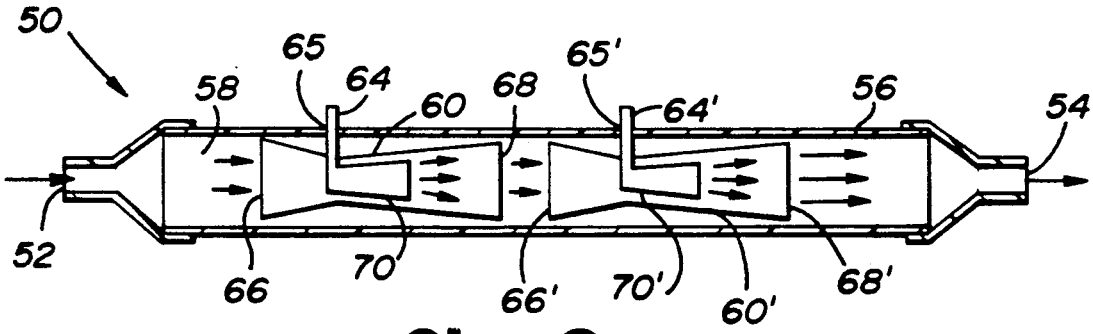
FIG. 2 is a longitudinal cross-sectional side view of a second embodiment of the present invention.

A second embodiment of the present invention is shown in FIG. 2 generally by reference numeral 50, and utilizes a plurality of gas injecting means to maximize the quantity of gas dissolved in the liquid.

In the second embodiment, gas dissolution system 50 comprises a substantially closed chamber 56 having an inlet 52 through which the liquid enters the system, and an outlet 54 from which the liquid leaves the system. Substantially closed chamber 56 has an interior 58 for accommodating the plurality of gas injecting means 60 and 60'. The length of substantially closed chamber 56 can be extended to any length required to accommodate the requisite number of gas injecting means.

Gas injecting means 60 and 60' is comprised of a plurality of venturis 62 and 62'. As in the first embodiment, the plurality of venturis includes venturis having pipes 64 and 64', inlets 66 and 66', outlets 68 and 68' and horns 70 and 70'. Pipes 64 and 64' extend through orifices 65 and 65', are attached thereto, and connect to a gas supply means.

In the second embodiment, however, the diameter of venturi inlets 66 and 66' are sized to substantially equal the diameter of chamber 56. The area relationship of the first embodiment between venturi inlet and chamber is not applicable, because venturi 62' is utilized to maximize the amount of gas dissolved in the liquid.

The liquid enters substantially closed chamber 56 through inlet 52. The liquid thereupon enters venturi 62 and horn 70 and the gas is dissolved into the liquid as described in greater detail above. Upon exiting venturi 62, the modified liquid then enters venturi 62' and horn 70'. Gas dissolution occurs again and the twice-modified liquid then exits the system through outlet 54. Although not illustrated, check valves may be installed in pipes 64 and 64'.

By using multiple gas injecting means, and installing them in series, a higher degree of gas dissolution in the liquid results. Generally, the more gas injecting means installed in series, the higher the effective gas dissolution. This is due in part to the cavitation thereby induced in the liquid, and the acceleration and deceleration of the liquid as it swirls by and through the venturis. While such a relationship is not linear (the dissolution rate drops as the liquid approaches saturation), optimal configurations can be achieved for any desired level of results.

Figure 3:
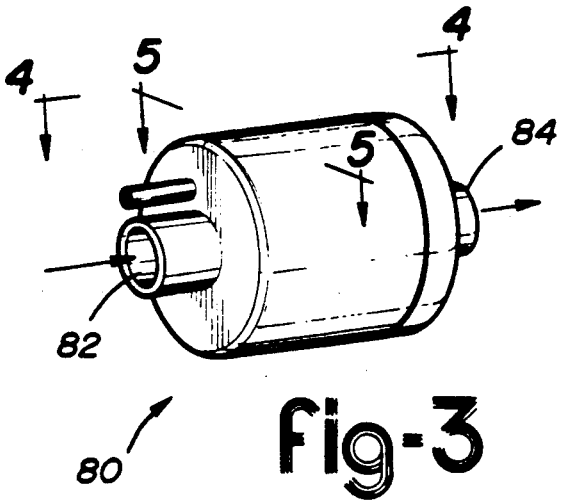
FIG. 3 is a perspective view of a third embodiment of the present invention.
Figure 4:
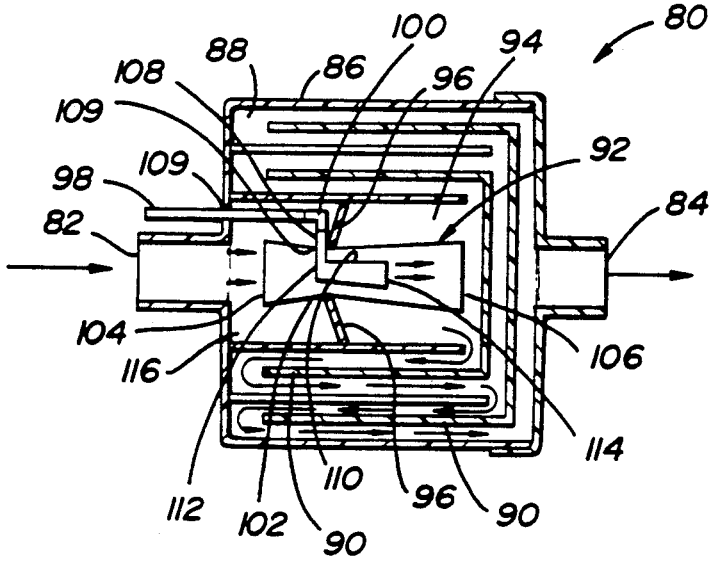
FIG. 4 is a longitudinal cross-sectional view of the embodiment shown in FIG. 3, taken along line 4—4 of FIG. 3.
Figure 5:
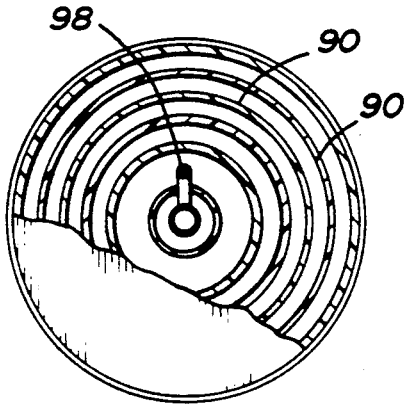
FIG. 5 is a cross-sectional view of the embodiment shown inn FIG. 3, taken along line 5—5 of FIG. 3.

Referring now to FIGS. 3-5, a third embodiment of the gas dissolution system is shown generally at 80. Substantially closed chamber 86 has an inlet 82, an outlet 84 and an interior 88 for accommodating a plurality of dividers 90 and gas injecting means 92. The dividers 90 cooperate with chamber 86 to create an open area 94 for accommodating gas injecting means 92. Gas injecting means 92 is supported in interior 88 by a plurality of supports 96, which are fixedly attached to dividers 90.

Gas injecting means 92 is comprised of a straight pipe 98, L-shaped pipe 100 and a venturi 102. Venturi 102 has an inlet 104, an outlet 106, a pipe 108 and a horn 110. Straight pipe 98 extends from a gas supply means located outside of chamber 86, to the interior 88 of chamber 86 through orifice 109 and is attached thereto. Straight pipe 98 is connected to L-shaped pipe 100, which is in turn connected to pipe 108, thereby establishing fluid communication between the gas supply means and venturi 102. Horn 110 is shaped and positioned in venturi 102 as in the previous embodiments and has an inlet 112 and an outlet 114. Although not illustrated, a check valve may be installed in pipe 98.

Chamber 116 is created by dividers 90 and supports 96. Since the supports 96 completely block fluid flow, this liquid enters chamber 116 through inlet 82. Since the supports 96 completely block fluid flow, this configuration assures that all liquid entering the system through inlet 82 passes through gas injecting means 92.

Upon entering chamber 116, the liquid enters venturi 102 through venturi inlet 104 and horn 110 through horn inlet 112. The area of venturi inlet 104 equals the area between the venturi inlet and the closed chamber 116. As described in greater detail above, by using a venturi with an inlet thus sized, the quantity of gas dissolved in the liquid is maximized.

Gas from the gas supply means is dissolved in the liquid as it passes through the venturi 102 and the horn 110, as in the previous embodiments.

The liquid exits venturi 102 through venturi outlet 106. Prior to exiting the system 80 through outlet 84, the liquid follows the tortuous path created in interior 88 by the dividers 90. The paths are designed to create a longer path of travel for the gas-liquid mixture than if the liquid exited chamber 86 immediately upon exiting the venturi 102.

As the liquid travels through the path, it interacts with any undissolved gas and any gas that may have already separated from the liquid, further maximizing the concentration of the gas in the liquid. Because the tortuous path actually surrounds venturi 102, a design moore compact than the previous embodiments results.

Figure 6:
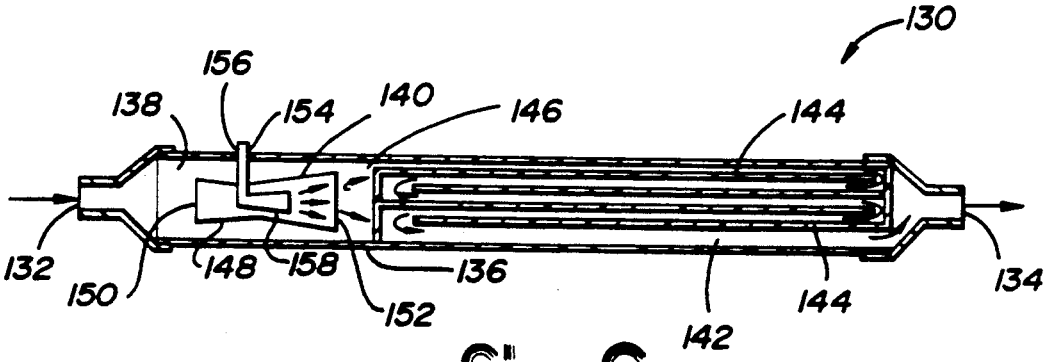
FIG. 6 is a longitudinal cross-sectional side view of a fourth embodiment of the present invention.

A fourth embodiment of the invention is illustrated in FIG. 6 and shown generally by reference numeral 130. Substantially closed chamber 136 has an inlet 132, an outlet 134 and an interior having two chambers. A plurality of dividers 144 cooperate with substantially closed chamber 136 to create chamber 138 and chamber 142. Chamber 138 disposes a gas injecting means 140 and is in fluid communication with chamber 142 through orifice 146.

Gas injecting means 140 is comprised of venturi 148 having an inlet 150, an outlet 152 and pipe 154. As in the second embodiment, pipe 154 extends through orifice 156 and connects to a gas supply means. Although not illustrated, a check valve may be installed in pipe 154.

The liquid enters chamber 138 through inlet 132. Then, the liquid enters venturi 148 and horn 158. As in the first and third embodiments, the area of venturi inlet 150 is equal to the area between the venturi inlet 150 and the chamber 138.

The venturi 148 and horn 158 operate in the manner described in the previous embodiments, and the modified fluid exits the venturi 148 at venturi outlet 152 and enters chamber 142 through orifice 146.

The liquid travels through the tortuous path created by the dividers 144 prior to leaving the system 130 through outlet 134. As described in greater detail above, as the gas-liquid mixture travels through the path, it continues to interact with any undissolved gas and any gas that may have already separated from the liquid, thereby maximizing the concentration of the gas in the liquid.

Because venturi 148 is not surrounded by the dividers 144 as in the third embodiment, gas dissolution system 130 can be utilized in applications requiring a longer, thinner gas dissolution system than the system of the third embodiment.

It is understood, of course, that while the forms of the invention herein shown and described constitute preferred embodiments of the invention, they are not intended to illustrate all possible forms thereof. It will also be understood that the words used are words of description rather than limitation, and that various changes may be made without departing from the spirit and scope of the invention disclosed.

What is claimed is:

1. A system for dissolving a gas delivered from a gas supply in a liquid which moves through the system, the liquid having the characteristic of being low in concentration of the gas upon entry into the system, the system comprising:

a substantially closed chamber having an inlet through which the liquid flows, an outlet from which the liquid leaves the system, and a central region therebetween, said central region having walls defining an interior adapted for dissolving the gas in the liquid and having one or moore orifices for introducing the gas into said chamber; and a venturi including a pipe section and a horn, said venturi having a venturi inlet into which the liquid flows and a venturi outlet from which the liquid flows, said horn having a horn inlet into which the liquid flows and a horn outlet from which the liquid flows, said venturi defining between said venturi inlet and said venturi outlet a passage which initially converges to a minimum spacing in the direction of liquid flow and thereafter widens more slowly, thereby creating a low pressure region in the path of liquid flow and permitting the liquid to siphon the gas from said pipe section and displace the gas into the liquid at high velocity from the incoming gas flow in the form of minute bubbles, the horn being in fluid communication with said pipe section and being positioned within the venturi such that said horn inlet is proximate to said low pressure region, said venturi maximizing a gas-liquid interface and promoting contact between the gas and the liquid, the horn optimizing the displacement of the gas into the liquid.

2. The gas dissolution system of claim 1 wherein said interior has a plurality of dividers that cooperate with said walls and ar fixedly attached thereto, to create a substantially open area inn said interior within which said venturi is disposed, and define a plurality of tortuous paths through which the liquid travels prior to exiting the system.

3. The gas dissolution system of claim 2 wherein said pipe section extends from outside of said chamber through one of said one or more orifices into said interior in a substantially horizontal orientation.

4. The gas dissolution system of claim 2 wherein said venturi is positioned substantially axially to the flow of liquid in said interior.

5. The gas dissolution system of claim 2 wherein the area of said venturi inlet is substantially equal to the area between said venturi inlet and said walls.

6. A system for dissolving a gas delivered from a gas supply in a liquid which moves through the system, the liquid having the characteristic of being low in concentration of the gas upon entry into the system, the system comprising:

a substantially closed chamber having an inlet through which the liquid flows, an outlet from which the liquid leaves the system, and a central region therebetween, said central region having walls defining an interior adapted for dissolving the gas in the liquid and having one or more orifices for introducing the gas into said chamber; and a venturi including a first pipe section and a horn, said first pipe section having a check valve for prohibiting flow of fluid from the chamber back to the gas supply means and extending to one of said one or more orifices and being attached thereto, said venturi having a venturi inlet into which the liquid flows, a venturi outlet from which the liquid flows and a venturi pipe section extending from the venturi to said one of said one or more orifices and being attached thereto, said horn having a horn inlet into which the liquid flows and a horn outlet from which the liquid flows, said venturi defining between said venturi inlet and said venturi outlet a passage which initially converges to a minimum spacing in the direction of liquid flow and thereafter widens more slowly, thereby creating a low pressure region in the path of liquid flow and permitting the liquid to siphon the gas from said pipe section and displace the gas into the liquid at high velocity from the incoming gas flow in the form of minute bubbles, the horn being in fluid communication with said venturi pipe section and being positioned within the venturi such that said horn inlet is proximate to said low pressure region, said venturi maximizing a gas-liquid interface and promoting contact between the gas and the liquid, the horn optimizing the displacement of the gas into the liquid.

7. The gas dissolution system of claim 6 wherein said venturi is positioned substantially axially to the flow of liquid in said interior.

8. The gas dissolution system of claim 6 wherein the area of said venturi inlet is substantially equal to the area between said venturi inlet and said walls.

9. A system for dissolving a gas delivered from a gas supply in a liquid which moves through the system, the liquid having the characteristic of being low in concentration of the gas upon entry into the system, the system comprising:

a substantially closed chamber having an inlet through which the liquid flows, an outlet from which the liquid leaves the system, and a central region therebetween, said central region having walls defining an interior adapted for dissolving the gas in the liquid and having one or more orifices for introducing the gas into said chamber; and a plurality of venturis, each venturi of said plurality of venturis including a pipe section and a horn, each venturi of said plurality of venturis having a venturi inlet into which the liquid flows and a venturi outlet from which the liquid flows, said horn having a horn inlet into which the liquid flows and a horn outlet from which the liquid flows, each of said venturis defining between said venturi inlet and said venturi outlet a passage which initially converges to a minimum spacing in the direction of liquid flow and thereafter widens more slowly, thereby creating a low pressure region in the path of liquid flow and permitting the liquid too siphon the gas from said pipe section and displace the gas into the liquid at high velocity from the incoming gas flow in the form of minute bubbles, said horn being in fluid communication with said pipe section and being positioned within said venturi such that said horn inlet is proximate to said low pressure region, said plurality of venturis maximizing a gas-liquid interface and promoting contact between the gas and the liquid, the horns optimizing the displacement of the gas into the liquid.

10. The gas dissolution system of claim 9 wherein said pipe section extends from said venturi through one of said one or more orifices to outside said chamber.

11. The gas dissolution system of claim 9 wherein said plurality of venturis are configures in series in said interior so that effluents from an upstream venturi enter an adjacent downstream venturi, thereby enhancing the intermixture and dissolution of the gas in the liquid.

12. The gas injecting means of claim 9 wherein each venturi of said plurality of venturis is sized such that the diameter of said venturi inlets is substantially equal to the diameter of said interior.

* * * * *